United States Patent [19]

Schneider

[11] 4,402,456

[45] Sep. 6, 1983

[54] DOUBLE DUMP SINGLE SOLENOID UNIT INJECTOR

[75] Inventor: Michael J. Schneider, Birmingham, Mich.

[73] Assignee: The Bendix Corporation, Southfield, Mich.

[21] Appl. No.: 364,723

[22] Filed: Apr. 2, 1982

[51] Int. Cl.[3] ..... F02M 47/02

[52] U.S. Cl. ..... 239/90; 239/91; 239/95; 239/125

[58] Field of Search ..... 239/88, 90, 91, 92, 239/93, 94, 95, 125, 585

[56] References Cited

U.S. PATENT DOCUMENTS

| | | | |
|---|---|---|---|
| 3,831,846 | 8/1974 | Perr et al. | 239/95 X |
| 4,235,374 | 11/1980 | Walter et al. | 239/90 |
| 4,281,792 | 8/1981 | Sisson et al. | 239/90 X |

*Primary Examiner*—Andres Kashnikow
*Assistant Examiner*—Mary McCarthy
*Attorney, Agent, or Firm*—Markell Seitzman; Russel C. Wells

[57] ABSTRACT

A cam driven fuel injector comprising: a body defining a bore; a driven or pumping piston reciprocatively situated with the bore; a metering piston reciprocatively positioned within the bore remote from the pumping piston; and a metering chamber defined in the bore below the metering piston. A spring is situated within a cavity or spring cage remote from the bore and a nozzle extends into the spring cage in biasing engagement with the spring to urge it to a closed position during non-injecting periods. The injector further including means for dumping the fuel within the metering chamber to the supply through the spring cage in correspondence with the motion of the metering piston; and for stabilizing the pressure force exerted on the nozzle, during the dumping portion of operation, by the fuel within the spring cage with the pressure force exerted on the nozzle.

10 Claims, 6 Drawing Figures

DOUBLE DUMP SINGLE SOLENOID UNIT INJECTOR

CROSS REFERENCE TO RELATED APPLICATIONS

This application is related to Ser. No. 282,629 filed July 13, 1981, which application is commonly assigned.

BACKGROUND OF THE INVENTION

The instant invention relates generally to fuel injection systems, and more particularly to electrically operated diesel unit injectors having a control valve for separately regulating each of the timing and metering of fuel in the fuel injector forming a part of the fuel regulating and distributing system, thereby permitting separate adjustment of both timing and metering of fuel from the various nozzle portions of the injectors in response to engine operating conditions.

Fuel injectors that are driven mechanically from the crankshaft of an internal combustion engine to deliver fuel into the cylinders of an internal combustion engine are well known; see, for example, U.S. Pat. No. 2,997,994, granted Aug. 29, 1961 to Robert F. Falberg. The movement of the crankshaft is translated into a force that periodically depresses the pump plunger via a cam, cam follower, and rocker arm mechanism. Since the rotation of the crankshaft reflects only engine speed, the frequency of the fuel injection operation was not adjustable with respect to other engine operating conditions. To illustrate, at cranking speeds, at heavy loads, and at maximum speeds, the timing and the metering (quantity) function for the fuel injector did not take into account actual engine operating conditions.

In order to enable adjustments to be made in the timing of the fuel injection phase of the cycle of operation, Falberg proposed that a fluid pressure pump introduce fluid into a follower chamber to elevate a plunger and thus alter the position of push rod which operates plunger member of the fuel injector. By selecting the effective area of the plunger, the elevation thereof advances the plunger member relative to the desired point in the cycle of engine operation. The fluid pressure pump is driven by the internal combustion engine, and a lubricating oil pressure pump is frequently utilized as the fluid pressure pump.

U.S. Pat. No. 3,859,973, granted Jan. 14, 1975 to Alexander Dreisin, discloses a hydraulic timing cylinder that is connected to the lubricating oil system for hydraulically retarding, or advancing, fuel injection for the cranking and the running speeds of an internal combustion engine. The hydraulic timing cylinder is positioned between the cam which is secured to the engine crankshaft and the hydraulic plunger. The pressure in the lubrication oil pump is related to the speed of the engine, as shown in FIG. 1.

U.S. Pat. No. 3,951,117, granted Apr. 20, 1976 to Julius Perr, discloses a fuel supply system including hydraulic means for automatically adjusting the timing of fuel injection to optimize engine performance. The embodiment of the system shown in FIGS. 1-4 comprises an injection pump including a body having a charge chamber and a timing chamber formed therein. The charge chamber is connected to receive fuel from a first variable pressure fuel supply and the timing chamber is connected to receive fuel from a second variable pressure fuel supply, while being influenced by pressure modifying devices. The body further includes a passage that leads through a distributor which delivers the fuel sequentially to each injector within a set of injectors.

A timing piston is reciprocally mounted in the body of the injection pump in Perr between the charge and timing chambers, and a plunger is reciprocally mounted in the body for exerting pressure on fuel in the timing chamber. The fuel in the timing chamber forms a hydraulic link between the plunger and the timing piston, and the length of the link may be varied by controlling the quantity of fuel metered into the timing chamber. The quantity of fuel is a function of the pressure of the fuel supplied thereto, the pressure, in turn, being responsive to certain engine operating parameters, such as speed and load. Movement of the plunger in an injection stroke results in movement of the hydraulic link and the timing piston, thereby forcing fuel into the selected combustion chamber. The fuel in the timing chamber is spilled, or vented, at the end of each injection stroke into spill port and spill passage.

All of the above-described fuel injection systems employ hydraulic adjustment means to alter the timing of the injection phase of the cycle of operation of a set of injectors mechanically driven from the crankshaft of an internal combustion engine, and the hydraulic means may be responsive to the speed of the engine and/or the load imposed thereon. While the prior art systems functioned satisfactorily in most instances, several operational deficiencies were noted. For example, the hydraulic adjustment means functioned effectively over a relatively narrow range of speeds, and responded rather slowly to changes in the operating parameters of the engine. Also, problems were encountered in sealing the hydraulic adjustment means, for a rotor-distributor pump was utilized to deliver hydraulic fluid to each of the fuel injectors in the set employed within the fuel injection system. In order to provide a hydraulic adjustment means responsive to both speed and/or the load factor, as suggested in the Perr patent, an intricate, multicomponent assembly is required, thus leading to high production costs, difficulty in installation and maintenance, and reduced reliability in performance.

The commonly assigned U.S. Pat. Nos. to Walter et al 4,235,374 filed Jan. 25, 1979 and to Sisson et al 4,281,792 similarly filed Jan. 25, 1979 discloses a cam driven unit injector having a primary plunger and a secondary plunger spaced therefrom, the space therebetween forming a hydraulic link that is controlled by an electrically operated control valve. The volume below the secondary plunger defines a metering chamber which during certain phases of operation is dumped to a drain line and a supply through a check valve located within the secondary plunger. The volume between the primary and secondary plunger further defines a timing chamber which is similarly dumped to drain through a check valve located within the secondary plunger. The above described injector further includes a nozzle that is hydraulically linked with the metering chamber. Upon pressurization of the fuel within the metering chamber injection begins. Injection is terminated by dumping the fuel in the metering chamber through passages within the secondary plunger. The injector further includes a biasing spring situated within the timing chamber for urging the secondary plunger in a downward position, this action will insure that the secondary piston resides at the bottom of its stroke and is thereby pre-positioned to receive fuel during a subsequent metering portion of its cycle which thereafter urges the secondary plunger upward against the biasing spring to fill the metering chamber with a predetermined quantity or charge of fuel prior to the next injection cycle. While the above patents to Sisson et al solve many of the operational deficiencies noted in the hydraulic systems, the construction of the secondary piston having a plurality of check valves therein is unduly complicated. In addition, utilizing a biasing spring to urge the secondary plunger downward requires greater acceleration force to thereafter cause The commonly assigned patents to Walter et al U.S. Pat. Nos. 4,235,374 filed Jan. 25, 1979 and to Sisson et al 4,281,792 not "The commonly assigned patents to Sisson et al 4,235,374 filed Jan. 25, 1979 and 4,281,792". pressurized fuel within the timing chamber and the metering chamber is dumped directly to the supply, pressure surges are created which can decrease the accuracy of performance of similar injectors that are connected in common to the same supply. Finally, injection termination is slowed since the nozzle will close only after the pressure in the metering chamber has been reduced to a relatively low value.

Thus, with the deficiencies of the known fuel injector systems it is an object of the present injection to employ one electronically operated control valve for each injector utilized within a fuel injection system. The preferred embodiment of the invention uses a two-way control valve. However, other valves such as a three-way control valve may be used. The function of the control valve is to control the timing of the injection phase of operation and also to control the duration of fuel metering into the metering chamber. A further object of the present invention is to provide a unit injector that is characterized as having a rapid nozzle closure. A further object of the pesent invention is to dampen pressure surges that are generated upon dumping the highly pressurized fuel in the metering chamber before these pressure surges reach the supply. A further object of the present invention is to provide a reference of position for the secondary or metering piston that is spaced from the lower extreme of the metering chamber to provide for the more accurate metering of fuel thereto.

According to the specific embodiments of the invention illustrated in the drawings of this application and discussed in detail below, the invention comprises: A cam driven fuel injector having a supply port adapted to be connected to a supply or source of fuel and a drain port. The fuel injector further comprises a body defining a bore; a driven or pumping piston reciprocatively situated with the bore; a metering piston reciprocatively positioned within the bore remote from the pumping piston; a timing chamber defined in the bore between the pumping piston and the metering piston; a metering chamber defined in the bore below the metering piston; a spring situated within a cavity or spring cage remote from the bore; a nozzle, having a needle valve, a nozzle passage surrounding the needle valve and at least one flow orifice; the nozzle extending into the spring cage in biasing engagement with the spring to urge the needle valve to close at least one flow orifice during non-injecting periods; first means for supplying fuel at supply pressure to the timing chamber and to the metering chamber; first dump means for permitting fuel within the timing chamber to be dumped therefrom in correspondence with the motion of the metering piston; first passage means for transmitting fuel from the metering chamber to the nozzle; and second dump means for dumping the fuel within the metering chamber to the supply through the spring cage in correspondence with the motion of the metering piston and for stabilizing the pressure force exerted on the nozzle, during the dumping portion of operation, by the fuel within the spring cage with the pressure force exerted on the nozzle by the fuel within said nozzle passage.

Many other objects and purposes of the invention will be clear from the following detailed description of the drawings.

DESCRIPTION OF THE PREFERRED EMBODIMENT OF THE INVENTION

Figure 1:
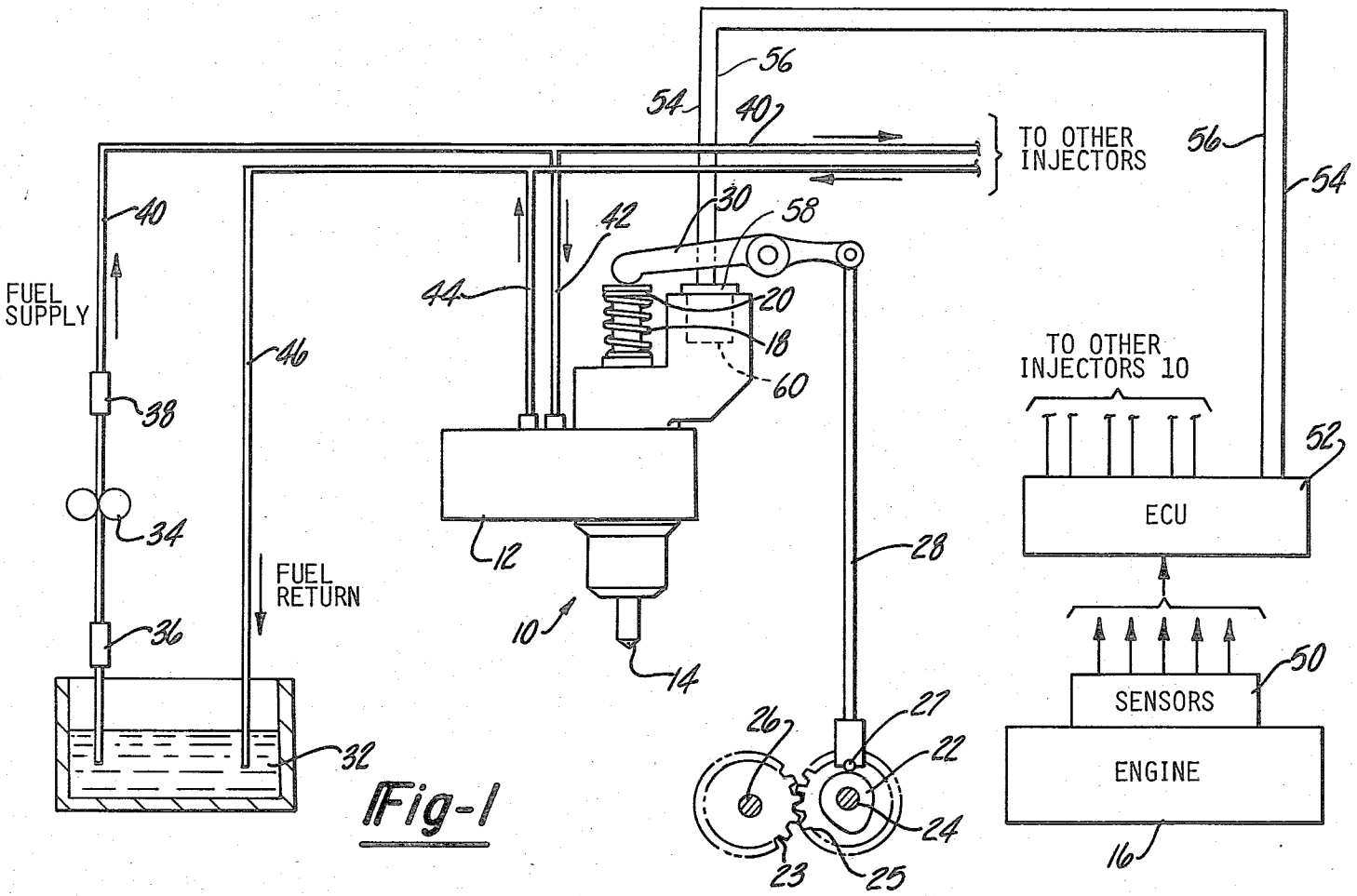
FIG. 1 is a schematic diagram of a fuel system.

Turning now to the drawings, FIG. 1 schematically depicts the major components of a fuel injection system employing an electronically operated control valve 60 for regulating the timing function, and the time portion of a pressure-time metering function of each injector 10 within the system. The system includes at least one fuel injector 10 supported by a support block 12 that may be part of an engine 16. The fuel injector 10 is controlled to deliver fuel through a nozzle 14 directly into the combustion chamber of the internal combustion engine 16. Although only one injector is shown, it should be noted that a set of injectors is employed within the fuel injection system, one injector being provided for each cylinder in the engine. The injector 10 is operated synchronously with the opration of the engine 16 through the reciprocal action of a follower 20. The follower 20 is biased upwardly by a heavy duty spring 18.

A cam 22 is secured to the camshaft 24 of the internal combustion engine 16. Cam 22 rotates at a speed which is a function of engine speed. The camshaft is driven via meshing gears 23, 25 from the crankshaft 26. The gear ratio of gears 23, 25 may vary from engine to engine depending on various factors, including, inter alia, whether the engine is a two-cycle or four-cycle engine. The crankshaft drives the pistons (not shown) within the combustion chambers of the engine 16 in the usual manner. A roller 27 rides along the profile of the cam 22, and a push rod 28 and rocker arm 30 translate the movement of the follower into axially directed forces upon the follower 20 and the primary piston. The forces act in opposition to the main spring 18 and vary in magnitude with the speed of the engine and the profile of the cam 22.

A reservoir 32 serves as a source of supply for the fuel to be dispensed by each injector 10. Fuel is withdrawn from the reservoir by transfer pump 34. Filters 36, 38, remove impurities from the fuel, and a distribution conduit 40 introduces the fuel, at supply pressure, to each of the injectors 10. A branch conduit 42 extends between distribution conduit 40 and injector 10 and makes fuel, at supply pressure, available for circulation through injector 10. The fuel that is not dispensed into a combustion chamber in the engine is returned to the reservoir 32 via branch return conduit 44 and return conduit 46. Directional arrows adjacent to the conduits indicate the direction of fuel flow.

The fuel injection system of FIG. 1 responds to several parameters of engine performance. In addition to engine speed, which is inherent in the rate of rotation of the cam 22 secured upon camshaft 24, several sensors 50 are operatively associated with engine 16 to determine, inter alia, engine speed, temperature, manifold absolute pressure, load on the engine, altitude, and air-fuel ratio. The sensors 50 generate electrical signals representative of the measured parameters, and deliver the electrical signals to the electronic control unit, or ECU 52. The electrical control unit 52 may then compare the measured parameters with reference values or tables which may be stored within a memory in the ECU 52 to generate a signal to be delivered to each injector. The signal, in turn, governs the timing and at least a portion of the metering functions of each injector. Leads 54, 56 and a connector 58 interconnect the electronic control unit 52 to a control valve 60 for the representative injector 10 shown in FIG. 1.

Figure 2:
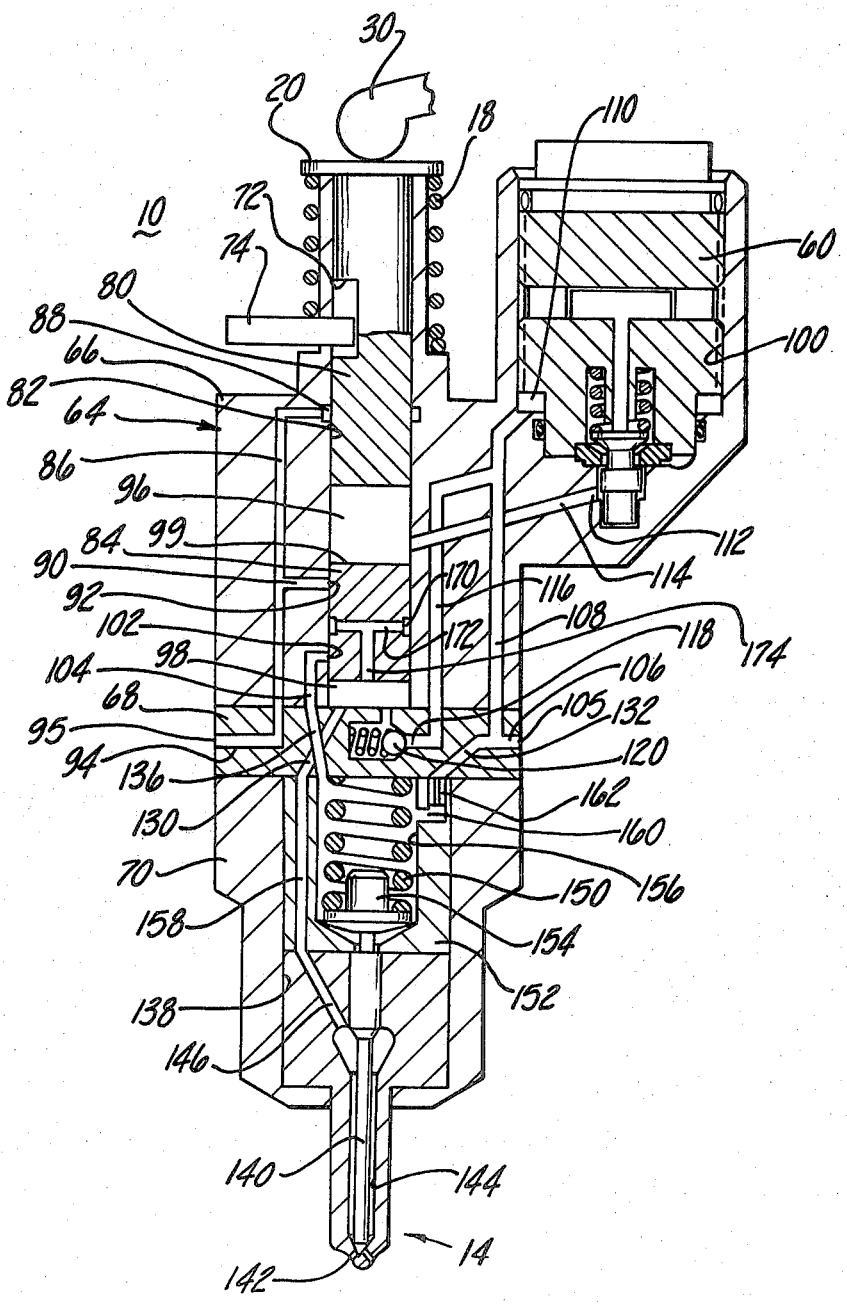
FIG. 2 is a schematic diagram, showing a vertical cross-sectional view of a fuel injector utilized within the fuel system of FIG. 1.

Referring now to FIG. 2 there is schematically illustrated the component of a representative injector 10. The injector 10 includes a body 64 having upper 66, middle 68 and lower 70 members. At the upper end of the injector 10, a fragment of the rocker arm 30 is illustrated bearing against the enlarged end of the follower 20. The main spring 18 rests on the upper member 66 of the body 64 and urges the follower 20 upward. A primary, driven or pumping piston 80 is joined to the lower end of follower 20. The follower 20 and pumping piston 80 moves as a unitary member. A slot 72 cooperates with a stop 74 to prevent the follower 20 and spring 18 from becoming disassembled from the injector body 64 prior to association with the rocker arm 30.

The upper body member 66 is provided a central bore 82 which is adapted to receive the lower end of the pumping piston 80 and also receives a secondary, floating or metering piston 84. The upper body member 66 is further provided with a fuel dump passage 86 which terminates at its upper end at a collection annulus 88 which is formed about the upper extreme of the central bore 82. The fuel dump passage 86 similarly communicates with the central bore 82 through a medial passage 90 forming a timing chamber dump port 92. The fuel dump passage 86 terminates at its lower end at a similarly positioned return passage 94 fabricated within the middle body member 68. The return passage 94 is connected (not shown) to the branch return conduit 44 of FIG. 1. The open outward extending end of the return passage 94 forms a drain port 95.

The cavity formed between the lower end of pumping piston 80 and the upper end of metering piston 84 forms a variable volume timing chamber 96. The bottom of the bore 82 and the bottom of the metering piston 84 form a variable volume metering chamber 98.

The upper body member 66 is adapted to receive the control valve which is housed within a stepped bore. In the embodiment of the invention illustrated herein the control valve 60 is a two-way valve of a known variety that permits fuel to flow from a supply to control the introduction of fuel, as hereinafter described, into the timing chamber 96. It should be appreciated that the control valve 60 need not be positioned within the injector 10 but may be located remote therefrom. The control bore 82 of the upper body member 66 includes a metering dump port 102 that is connected to an axially extending passage 104.

Fuel is fed to the injector 10 from the reservoir 32 by means of a supply port 105 and supply passage 106 located in the middle body member 68. Fuel is communicated from the supply passage 106 through passage 108 in the upper body member 66 and to the inlet 110 of the control valve 60. Fuel is communicated from the control valve outlet 112 through a timing passage 114 which terminates at the central bore 82 to provide fuel communication between the control valve 60 and the timing chamber 96. Fuel is communicated to the metering chamber 98 from the supply passage 106 through a metering passage 116 which terminates at one end at passage 108 and which terminates at its other end with a cooperating passage 118 fabricated within the middle body member 68. The passage 118 terminates at its other end in the metering chamber and further includes a check valve 120 that is connected in such a manner as to prohibit fuel from flowing from the metering chamber 98 back into the metering passage 116.

The middle body member 68 further includes an additional passage 130 which communicates fuel from the metering chamber 98 to a needle valve 140 (situated within nozzle 14) and fuel passage 132 which communicates fuel from the supply to a spring cage 156 and another passage 136 which communicates fuel from the passage 104 through to the spring cage 156.

Reference is briefly made to the lower portion of FIG. 2, in particular, the lower body member 70 further includes a stepped bore 138 that is sized to receive the nozzle 14. The nozzle 14 may include a needle valve 140 of a known variety which opens and closes a plurality of flow orifices 142. The needle valve 140 is loosely received within a central passage 14 that is connected to passage 146 which receives fuel from the metering chamber through passages 130 and 158.

During non-injecting periods of operation the needle valve 140 is biased to close the flow orifices 142 by the operation of a spring 150 that is housed within a central bore or spring cage 156 formed in the spring retainer 152. The needle valve 140 is connected to the spring 150 through a seat element 154 which serves to stabilize and guide the motion of the needle valve 140. The spring retainer 152 is received within the bore 138 of the lower housing member 70 and is sandwiched between the nozzle 14 and the middle housing member 68. The spring retainer 152 further includes the axially extending passage 158 which as previously mentioned communicates fuel from the passage 130 through to the passage 146. The spring retainer further includes a fuel passage 160 having a vent orifice 162 situated therein which connects the spring cage 156 to the supply passage 132.

Reference is again made to the metering piston 84 and its relation to the metering chamber dump port 102. The metering piston further contains an annulus 170 fabricated within its walls. A crosshole 172 links the annulus 170 with an axial hole 174 which terminates at the lower end of the metering piston 84. As described more fully below as the metering piston 84 is urged toward the bottom of its stroke by the fluid within the timing chamber 96 the annulus 170 will be positioned adjacent to the metering dump port 102 therein providing a means for relieving the pressure of the fuel within the metering chamber 98 and fuel surrounding the needle valve 140. As the metering piston 84 is further urged downward its upper edge 99 moves across and opens the timing chamber dump port 92 therein relieving the pressure of the fuel within the timing chamber and permitting the fuel to flow to drain. The sequence of dumping may be interchanged or performed simultaneously. The annulus 170, crosshole 172 and axial hole 172 may be replaced by other means for dumping fuel from the metering chamber 98 such as larger annulus fabricated in the metering piston 84 that would connect the metering chamber dump port 102 to an enlarged portion of the central bore 82 that comprises the metering chamber 98.

Figure 3:
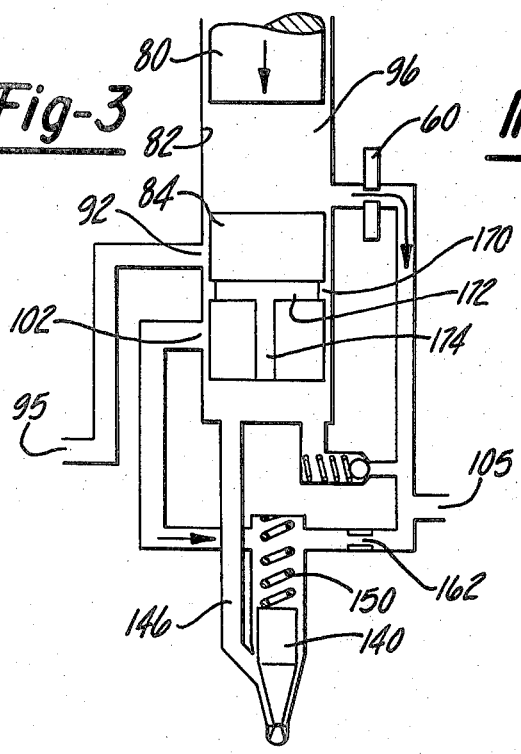
FIGS. 3–6 show the various modes of operation of the fuel injector of FIG. 2.

Describing now the operation of the injector 10. The injector 10 can be operated in a volumetric fuel metering mode of operation which is described in the commonly assigned U.S. Pat. No. 4,281,792 which is herein expressly incorporated by reference. The following description of the operation of the injector 10 describes the volumetric type of metering. Reference is now made to FIG. 3 which depicts a pre-injection or adjustable timing phase of operation. Prior to this phase or mode of operation a predetermined charge of fuel has been permitted to enter the metering chamber 98 and the secondary or metering piston 84 is positioned as illustrated in FIG. 3 closing off the timing and metering dump ports 92 and 102 respectively. The cam-driven pumping piston 80 is urged downward by the rocker arm 30 therein causing the pumping piston 80 to descend into and compress the fuel within the timing chamber 96. During this pre-injection phase the control valve 60 is maintained in an open position consequently, the fuel within the timing chamber 96 is pumped back to the supply as indicated by the arrows. As long as the control valve 60 is maintained in the open position the motion of the pumping piston 80 will not cause the metering piston 84 to move from the above mentioned position.

Figure 4:
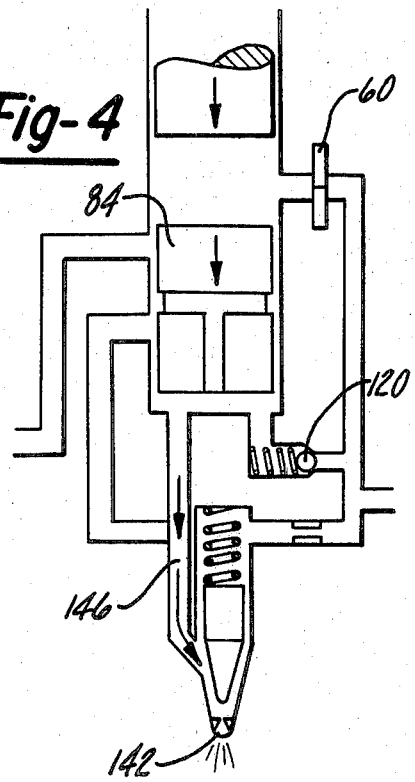

Reference is now made to FIG. 4 which illustrates the injection phase or mode of operation. In response to a signal generated by the ECU 52 (FIG. 1) the control valve 60 is closed therein forming a hydraulic link between the pumping piston 80 and the metering piston 84. During the injection mode of operation the pumping piston 80 is urged downward therein compressing the fuel within the timing chamber 96 which thereupon urges the metering piston 84 downward to compress the fuel within the metering chamber 98. The increased pressure within the metering chamber is communicated to the fuel passages 144 and 146 surrounding the needle valve 140 which causes the needle valve 140 to be lifted from its seat therein permitting fuel to be injected from the flow orifices 142 thus beginning injection. During the injection mode of operation the pumping piston 80 continues to exert a force on the metering piston 84 and moves the metering piston 84 into a position wherein the metering chamber dump port 102 and timing chamber dump port 92 are opened by the annulus 170 and the upper edge 99 of the metering piston 84 respectively.

Figure 5:
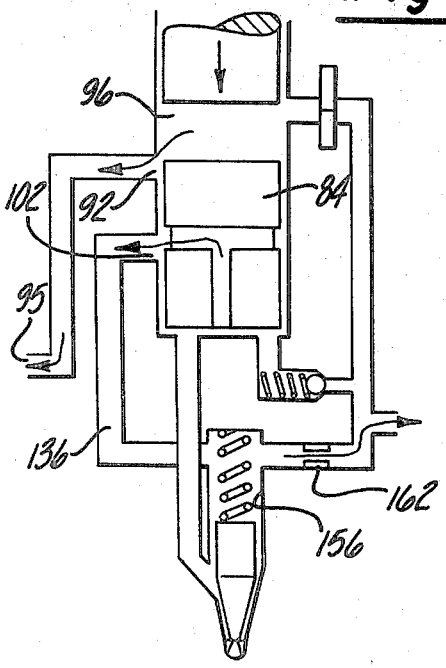

FIG. 5 illustrates, inter alia, the position of the metering piston 84 during the dump mode or phase of operation. The edges of the metering piston 84 that is, its top edge 99 and the lower edge of the annulus 170 have been moved to expose the metering and timing chamber dump ports 102 and 92 respectively. The high pressure fuel residing in the timing chamber 96 flows out of the injector 10 through the drain line 94 therein causing a very rapid loss of timing chamber pressure. Similarly the highly pressurized fuel within the metering chamber 98 flows through the metering dump port 102 to supply through the spring cage 156 and vent orifice 162. Because of this flow, the pressure within the metering chamber 98 and the pressure within the spring cage 156 tend to equalize rapidly. This causes an equalization of the pressure forces above and below the needle valve 140 therein permitting the needle valve to be urged downward independent of the pressure within the metering chamber and substantially only by the force of the spring 150 to thereupon close the flow passages 142. This permits the nozzle 14 to close even though the pressure in the metering chamber 98 and passage 144 surrounding the needle valve 140 are relatively high. The fuel from the metering chamber 98 continues to flow through the vent orifice 162 to the supply until the pressure of the fuel within the spring cage 156 and in the metering chamber 98 have dropped to the supply pressure. Inasmuch as the dumping rate of fuel from the metering chamber is limited by the vent orifice 162, the metering piston 84 tends to be stopped before it can strike the bottom of the metering chamber 98. During this mode of operation the cam driven pumping piston 80 will continue to move completely downward by the action of the rocker arm 30. As the pumping piston 80 slows to a stop at its maximum extension, the metering piston 84 will rise to its reference position as fuel flows from the timing chamber 96 to the drain line 94 and from the supply into the metering chamber 98. The above described referencing phase occurs prior to the beginning of the retraction phase of the pumping plunger 80. Referencing occurs as the downward velocity of the pumping plunger approaches zero and continues during the subsequent dwell of the pumping plunger, if there is such a dwell provided by the cam 22. During this time fuel will flow from the supply to the metering chamber 98 through both the check valve 120 and the metering dump port 102. The motion of the metering piston 84 will slow as its top edge approaches the top edge of the timing dump port 92 and reduces the dump area. The metering piston 84 will thereafter seal off flow from the timing chamber 96 to the drain line 94. As can be seen any pressure surges that might be caused by the rapid dumping of the metering chamber 98 are damped by permitting the metering chamber to be dumped to the supply through the spring cage 156 and vent orifice 162.

Figure 6:
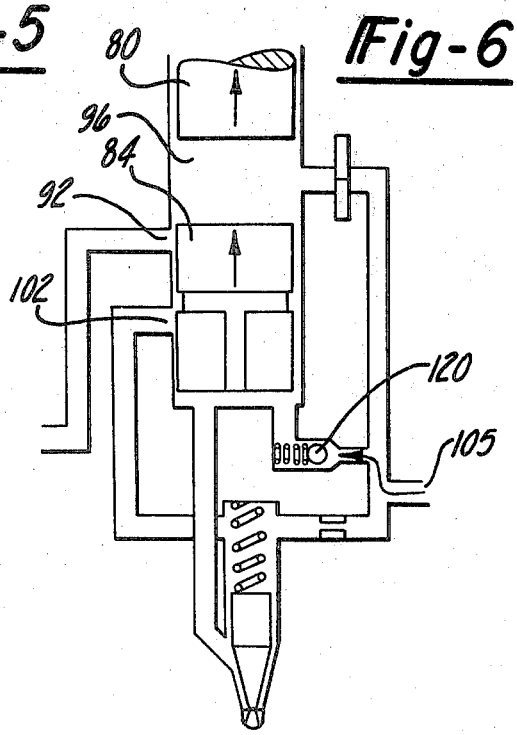

The metering phase or mode of operation of the fuel injector 10 is illustrated in FIG. 6. As the pumping piston 84 begins to retract a low pressure is created within the timing chamber. Furthermore a pressure differential is created across the metering piston 84 thus causing the metering piston to rise and permit fuel to be drawn into the metering chamber from the supply through the check valve 120. As the metering piston 84 continues to rise the metering chamber dump port 102 is quickly sealed off. After the desired amount of fuel has been metered into the metering chamber 98 the ECU 52 opens the control valve 60, fuel flows into the timing chamber therein stabilizing both the timing chamber and the metering chamber at substantially the pressure of the supply and causing an equilibrium condition thereacross. The metering piston 84 will tend to remain in this predetermined position while the pumping piston 80 is more fully retracted. Prior to the next injection phase of operation the pumping piston will be urged downward again and the injector will again enter the preinjection phase of operation as illustrated in FIG. 3.

Many changes and modifications in the above-described embodiments of the invention can of course be carried out without departing from the scope thereof. Accordingly, that scope is intended to be limited only by the scope of the appended claims.

What is claimed is:

1. A cam driven fuel injector having a supply port adapted to be connected to a supply or source of fuel and a drain port comprising:

a body defining a bore;

a driven or pumping piston reciprocatively situated with said bore;

metering piston reciprocatively positioned within said bore remote from said pumping piston;

a timing chamber defined in said bore between said pumping piston and said metering piston;

a metering chamber defined in said bore below said metering piston;

a spring situated within a cavity or spring cage remote from said bore;

a nozzle, having a needle valve, a nozzle passage surrounding said needle valve and at least one flow orifice, said nozzle extending into said spring cage in biasing engagement with said spring to urge said needle valve to close said at least one flow orifice during noninjecting periods;

first means for supplying pressurized fuel to said timing chamber and to said metering chamber;

first dump means for permitting fuel within the timing chamber to be dumped therefrom in correspondence with the motion of said metering piston;

first passage means for transmitting fuel from said metering chamber to said nozzle;

second dump means for dumping the fuel within said metering chamber to the supply through said spring cage in correspondence with the motion of said metering piston; and for stabilizing the pressure force exerted on said nozzle, during the dumping portion of operation, by the fuel within said spring cage with the pressure force exerted on said nozzle by the fuel within said nozzle passage.

2. The fuel injector as defined in claim 1 wherein said second dump means includes a vent orifice.

3. The fuel injector as defined in claim 2 wherein said vent orifice interposes the supply and said spring cage.

4. The fuel injector as defined in claim 3 wherein said first means includes a fuel passage for transmitting fuel from the supply to said metering chamber, including a check valve lodged therein for prohibiting the reverse flow of fuel from said metering chamber.

5. The fuel injector as defined in claim 4 wherein said fuel passage includes an adjustable metering orifice means for controlling the rate of fuel flow to said metering chamber.

6. The fuel injector as defined in claim 5 wherein said first means includes an electrically responsive control valve interposing the supply and said timing chamber for opening and closing a timing passage to permit the controlled flow of fuel therebetween such that when said passage is closed, a hydraulic link is created between said pumping piston and said metering piston.

7. The fuel injector is defined in claims 1 or 6 wherein said second dump means includes a metering dump port in the wall of said bore, and an annulus, cross-hole linking said annulus to an axial extending hole in the metering piston.

8. A cam driven fuel injector for a diesel engine comprising:

body means forming a bore, a timing chamber dump port connected to a low pressure drain and a metering chamber dump port;

pumping piston means adapted to be driven by the cam, positioned within said bore for movement therein;

metering piston means positioned within said bore and spaced apart from and below said pumping piston means having means for selectively uncovering said timing chamber dump port and means for selectively connecting said metering chamber to said metering chamber dump port in correspondence with its motion;

a timing chamber defined in said bore between said pumping piston means and said metering piston means;

a metering chamber defined in said bore below said metering piston means;

a nozzle situated within said body means, remote from said metering chamber spring means situated within said body means and above said nozzle, including a bore or spring cage adapted at one end to receive a portion of said nozzle and adapted at its other end to receive fuel from said metering chamber dump port and further including first passage means for transmitting fuel to the supply having a vent orifice therein, said spring means further including a spring for biasing said nozzle in a closed position;

means for supplying pressurized fuel to said timing and said metering chambers, including a passage having a check valve lodged therein.

9. The fuel injector as defined in claim 8 wherein said supplying means includes an electrically responsive control valve.

10. The fuel injector as defined in claim 9 wherein said control valve is a two-way valve.

* * * * *